US008314759B2

(12) United States Patent
Lu et al.

(10) Patent No.: US 8,314,759 B2
(45) Date of Patent: Nov. 20, 2012

(54) APPARATUS AND METHOD FOR DISPLAYING AN IMAGE ON A DISPLAY UNIT AND CONTROLLING THE BACKLIGHT MODULE UTILIZED TO IRRADIATE THE DISPLAY UNIT

(75) Inventors: Yi-Liang Lu, Hsin-Chu (TW); Wen-Ho Hsiao, Hsinchu (TW); Shu-Yueh Ko, Taipei (TW)

(73) Assignee: MStar Semiconductor, Inc., ChuPei, Hsin-Chu Hsien (TW)

( * ) Notice: Subject to any disclaimer, the term of this patent is extended or adjusted under 35 U.S.C. 154(b) by 1155 days.

(21) Appl. No.: 11/616,869

(22) Filed: Dec. 28, 2006

(65) Prior Publication Data

US 2008/0062117 A1 Mar. 13, 2008

Related U.S. Application Data

(60) Provisional application No. 60/825,411, filed on Sep. 13, 2006.

(51) Int. Cl.
*G09G 3/36* (2006.01)

(52) U.S. Cl. ..... 345/87

(58) Field of Classification Search ..... None
See application file for complete search history.

(56) References Cited

U.S. PATENT DOCUMENTS

| | | | | |
|---|---|---|---|---|
| 5,717,422 | A | 2/1998 | Fergason | |
| 7,379,079 | B2 | 5/2008 | Kang | |
| 2004/0257329 | A1 * | 12/2004 | Park et al. | 345/102 |
| 2005/0057484 | A1 * | 3/2005 | Diefenbaugh et al. | 345/102 |

FOREIGN PATENT DOCUMENTS

CN 1604155 A 4/2005

* cited by examiner

*Primary Examiner* — Tammy Pham
(74) *Attorney, Agent, or Firm* — Winston Hsu; Scott Margo

(57) ABSTRACT

A method and an apparatus for displaying an image on a display unit and controlling a backlight module which irradiates the display unit are disclosed. The method includes: processing the image signal and generating a driving signal to drive the display unit; displaying contents of the image signal; analyzing luminance values of the image signal to generate a luminance analysis result; and generating a control signal to control the backlight module according to the luminance analysis result.

12 Claims, 5 Drawing Sheets

APPARATUS AND METHOD FOR DISPLAYING AN IMAGE ON A DISPLAY UNIT AND CONTROLLING THE BACKLIGHT MODULE UTILIZED TO IRRADIATE THE DISPLAY UNIT

CROSS REFERENCE TO RELATED APPLICATIONS

This application claims the benefit of U.S. Provisional application No. 60/825,411, filed Sep. 13, 2006, the subject matter of which is incorporated herein by reference.

BACKGROUND OF INVENTION

1. Field of the Invention

The present invention relates to a method and an apparatus for controlling a display device, especially to a method and an apparatus for displaying an image on an LCD device and controlling the backlight of the LCD device.

2. Description of the Prior Art

A contrast ratio is a key factor that determines the display quality of a display device, especially a liquid crystal display (LCD) device. The contrast ratio is affected by many factors such as the characteristics of the LCD panel, the quality of the image signal, the backlight that irradiates the LCD panel, and etc. People have been working so hard to improve the contrast ratio of the display device and some methods have been therefore disclosed. However, the conventional methods did not enhance the contrast ratio effectively.

SUMMARY OF INVENTION

It is therefore a primary objective of the claimed invention to provide a method and an apparatus for displaying an image on a display unit and controlling a backlight module which irradiates the display unit.

According to an embodiment of the claimed invention, a display apparatus is disclosed. The display apparatus includes a receiving circuit, an image processing circuit, a display unit, a luminance analysis circuit, a backlight module, and a backlight controller. The receiving circuit receives and processes an incoming signal to generate an image signal. The image processing circuit, which is coupled to the receiving circuit, processes the image signal and generates a driving signal. The display unit is coupled to the image processing unit and driven by the driving signal to display contents of the image signal. The luminance analysis circuit, which is coupled to the receiving circuit, analyzes the image signal and generates a luminance analysis result. The backlight module irradiates the display unit, and the backlight controller, which is coupled to the luminance analysis circuit and the backlight module, generates a control signal according to the luminance analysis result to control the backlight module.

According to another embodiment of the claimed invention, a control circuit for controlling a display unit and a backlight module, which irradiates the display unit, is disclosed. The control circuit includes an image processing circuit, a luminance analysis circuit, and a backlight controller. The image processing circuit receives and processes an image signal containing a plurality of image frames to be displayed on the display unit. The luminance analysis circuit receives the image signal and analyzes luminance values of the image signal to generate a luminance analysis result. The backlight controller, which is coupled to the luminance analysis circuit, generates a control signal to control the backlight module according to the luminance analysis result.

According to still another embodiment of the claimed invention, a method for displaying contents of an image signal on a display unit and controlling a backlight module utilized to irradiate the display unit according to an analysis of the image signal is disclosed. The method includes: processing the image signal and generating a driving signal to drive the display unit; displaying contents of the image signal; analyzing luminance values of the image signal to generate a luminance analysis result; and generating a control signal to control the backlight module according to the luminance analysis result.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the description and following claims to refer to particular components. As one skilled in the art will appreciate, electronic equipment manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". Also, the term "couple" is intended to mean either an indirect or direct electrical connection. Accordingly, if one device is coupled to another device, that connection may be through a direct electrical connection, or through an indirect electrical connection via other devices and connections.

Figure 1:
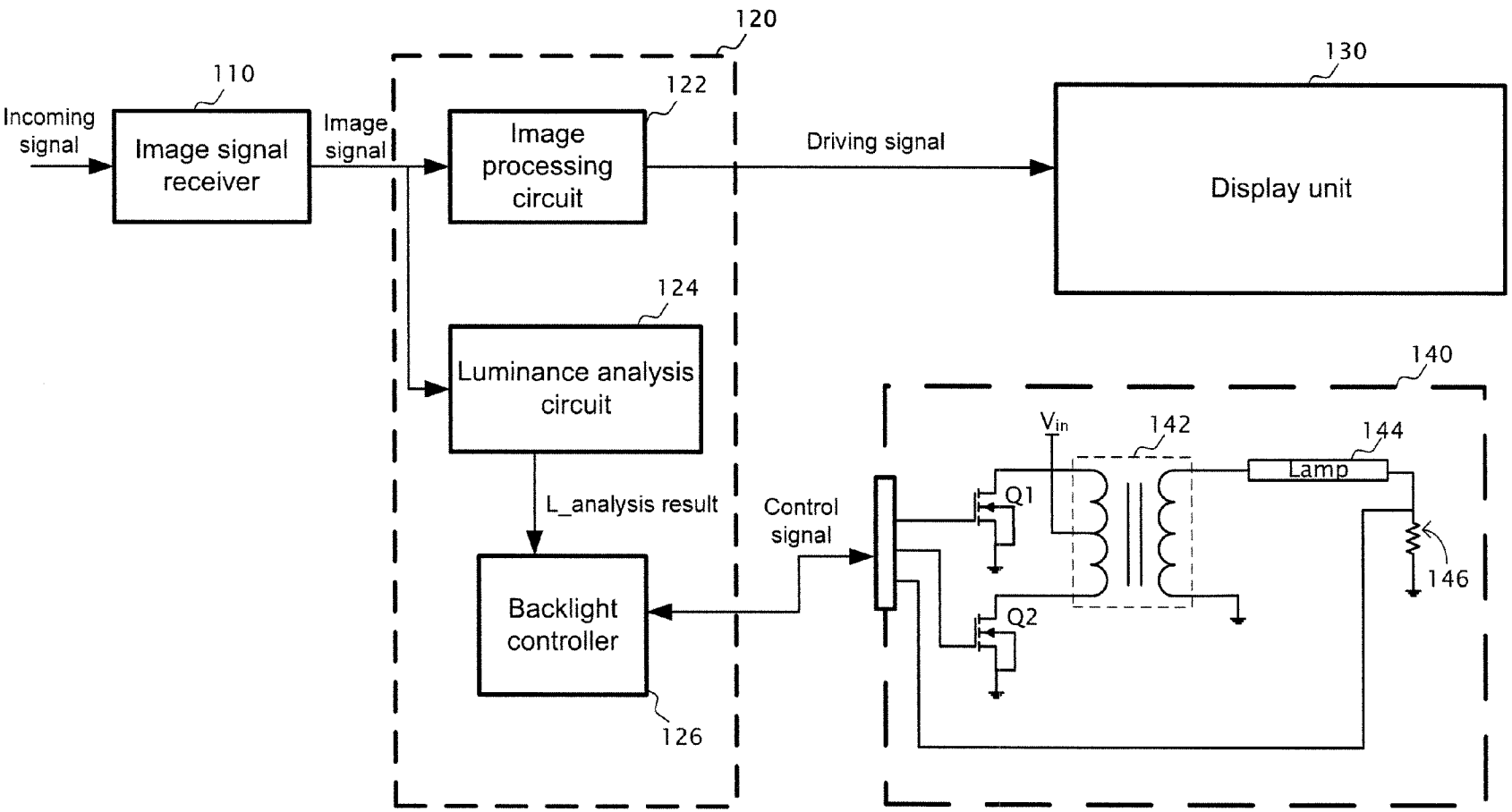
FIG. 1 shows a display device according to an embodiment of the present invention.

Please refer to FIG. 1. FIG. 1 shows a display device according to an embodiment of the present invention. The display device 100 includes a receiving circuit 110, a control circuit 120, a display unit 130, and a backlight module 140. The receiving circuit 110 is utilized for receiving an analog or a digital incoming signal through a wire or wirelessly. The incoming signal is then processed by the receiving circuit 110 to generate an image signal. The image signal contains a plurality of image frames, and each image frame consists of a number of pixels. The signal process performed on the incoming signal includes down-converting the incoming signal from an RF to an intermediate frequency or a base band, demodulating and optionally analog-to-digital converting if the incoming signal is an analog signal.

The image signal is then transmitted to the control circuit 120. The control circuit 120 includes an image processing unit 122, a luminance analysis circuit 124, and a backlight controller 126. The image processing circuit 122 is coupled to receive the image signal and then performs operations on the image signal such as scaling, gamma correction, interpolation, filtering, etc, and outputs a driving signal to drive the display unit 130 such that the image frames of the image signal can therefore be shown on the display unit 130. The image signal is also received by the luminance analysis circuit 124. The luminance analysis circuit 124 collects the luminance value of each pixel of an image frame, and analyzes the luminance values to generate a luminance analysis result. This luminance analysis result stands for the luminance information or the brightness of the image frame. For example, a high luminance analysis result may represent a high brightness of an image frame.

The backlight controller 126 generates a control signal to control the backlight module 140 which irradiates the display unit 130. The backlight module 140 includes two MOSFET's Q1 and Q2, which respectively receive the control signal at the gate terminal. The backlight module 140 also includes a voltage transformer 142, a lamp 144, and a resistor 146. The voltage transformer 142 is connected to the two MOSFET's Q1, Q2, a voltage $V_{in}$ and a ground point. The lamp 144 is connected between the voltage transformer 142 and the resistor 146, and irradiates the display unit 130.

The control signal generated by the backlight controller 126 is a PWM signal. The brightness of the lamp 144 is related to the duty cycle of the PWN signal; therefore, by adjusting the duty cycle of the PWM signal, the brightness of the lamp 144 can be changed. The backlight controller 126 generates the control signal according to the luminance analysis result. The detailed description of how the luminance analysis circuit 124 generates the luminance analysis result is illustrated below.

Figure 2:
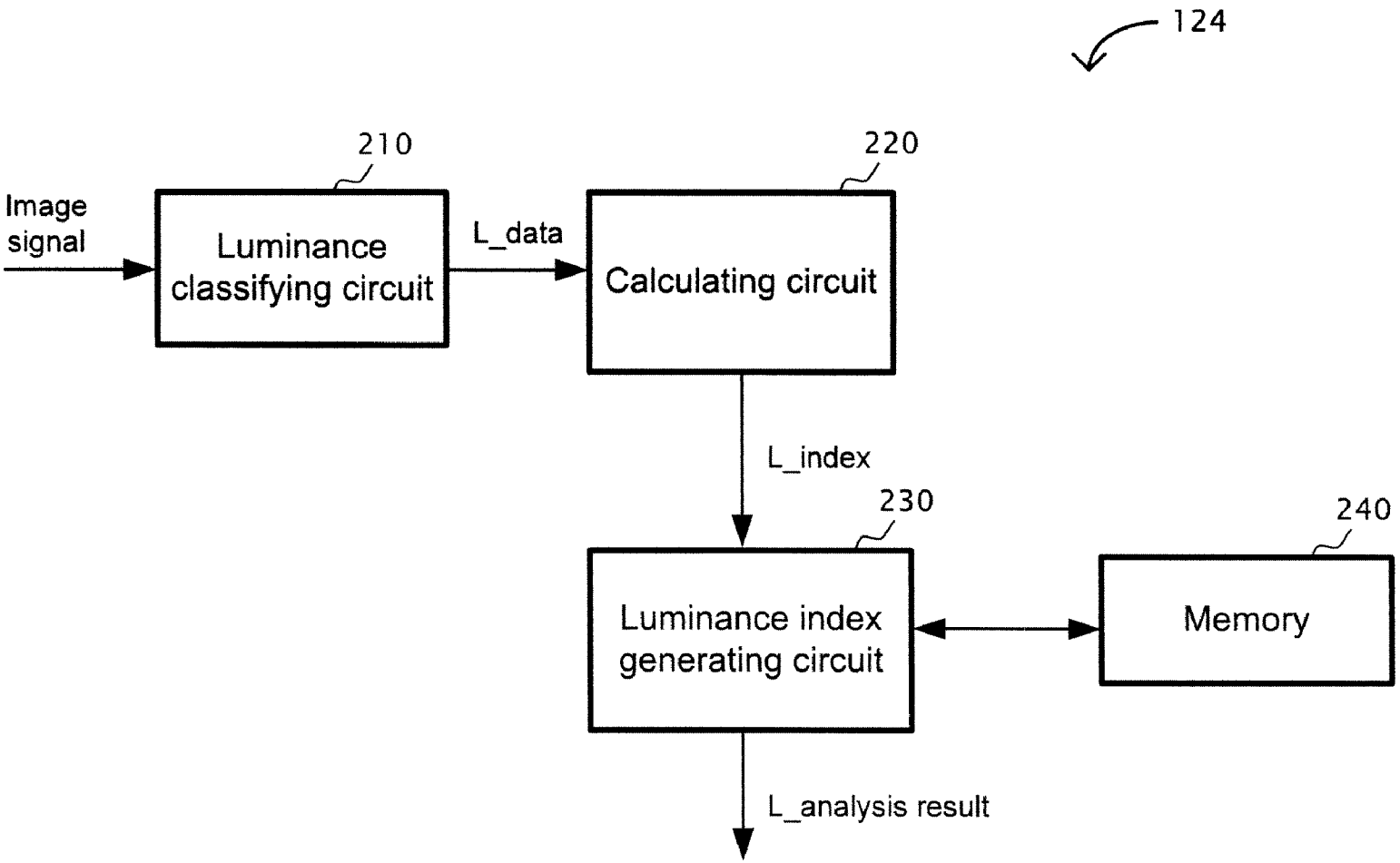
FIG. 2 shows the configuration of the luminance analysis circuit.
Figure 3:
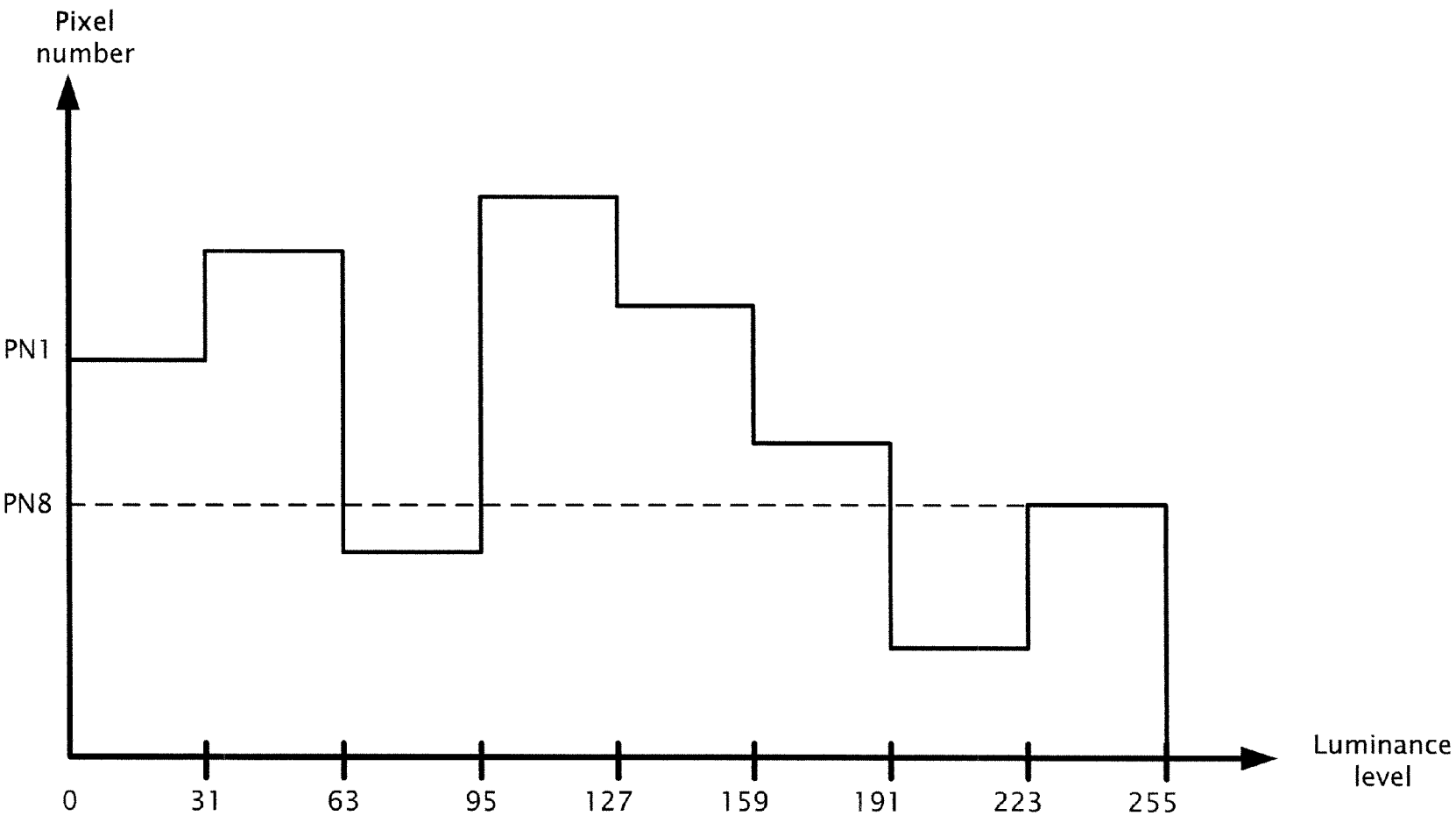
FIG. 3 shows the luminance data illustrated in the form of a histogram.

Please refer to FIG. 2. FIG. 2 shows the configuration of the luminance analysis circuit 124. The luminance analysis circuit 124 includes a luminance classifying circuit 210, a calculation circuit 220, a luminance index analyzing circuit 230, and a memory 240. The luminance classifying circuit 210 receives the image signal and classifies the luminance values of pixels in an image frame into several luminance levels. For example, assuming that the available luminance value of a pixel ranges from 0 to 255 and now are divided averagely into 8 sections according to the embodiment of the present invention, there should be 8 luminance levels each of which includes an equal number of 32 (i.e., 256/8) luminance values. The luminance values in each frame are classified and accumulated with respect to the luminance levels, and therefore a luminance data is generated. For clarity, the luminance data can be illustrated in charts such as a histogram. An example of the histogram representing the luminance data is shown in FIG. 3. The full range of the luminance value (e.g., from 0 to 255) is divided into 8 luminance levels. Each luminance level corresponds to a pixel number, which stands for the total number of pixels of an image frame falling in the corresponding luminance level. For example, the pixel number of the first (or the lowest) luminance level, with luminance value ranging from 0 to 31, is PN1, the pixel number of the last (or the highest) luminance level, with luminance value ranging from 223 to 255, is PN8, and the second to seventh luminance levels have a pixel number PN2 to PN7 respectively (not shown).

The luminance data is then calculated by the calculating circuit 220. The calculating circuit 220 calculates the number of pixels of each luminance level, i.e., the pixel numbers PN1 to PN8, or calculates the average luminance value of one image frame. For example, with respect to the exemplary luminance data shown in FIG. 3, the average luminance value, avg_LV, can be expressed as:

$$\text{avg_LV} = \frac{PN1 \times 15 + PN2 \times 47 + PN3 \times 79 + PN4 \times 111 + PN5 \times 143 + PN6 \times 175 + PN7 \times 207 + PN8 \times 239}{PN1 + PN2 + PN3 + PN4 + PN5 + PN6 + PN7 + PN8} \quad (1)$$

Then the calculating circuit 220 generates a luminance index, which stands for the brightness feature of the image frame. In the embodiment, the pixel numbers of each luminance level, PN1 to PN8, or the average luminance value, avg_LV, can be chosen to represent the luminance index, L_index, which is further transmitted to the luminance index analyzing circuit 230.

The luminance index analyzing circuit 230 analyzes the luminance index to generate the luminance analysis result. The memory 240, which is coupled to the luminance index analyzing circuit 230, stores lookup tables corresponding to the luminance index. For different bases of luminance indexes, the luminance index analyzing circuit 230 refers to different lookup tables to generate the luminance analysis result. For example, the memory 240 may store three different lookup tables, corresponding respectively to the pixel number of the lowest luminance level PN1, the pixel number of the highest luminance level PN8, and the average luminance value avg_LV. The type of the luminance index taken into consideration can be determined by the user. In another embodiment, where the luminance index does not contain just a pixel number or the average luminance value; however on the contrary, it may contain a set of values consisting selectively of PN1 to PN8 and age_LV, the luminance index analyzing circuit 230 will refer to the lookup table according to the set of values. For example, if PN1 and avg_LV are selected to be the set of values to represent the luminance index, the luminance index analyzing circuit 230 refers to a lookup table according to PN1 and avg_LV.

Figure 4:
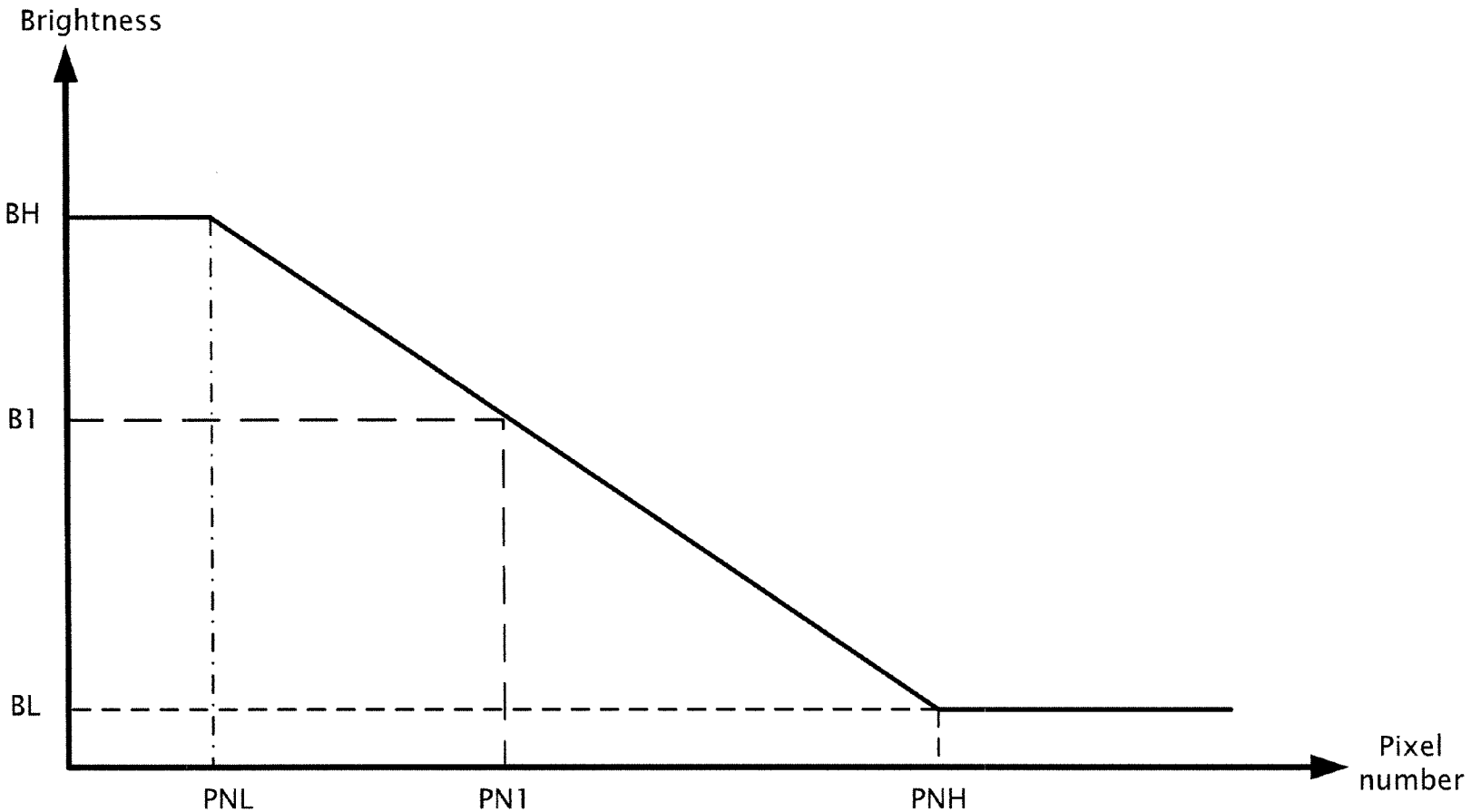
FIG. 4 shows the relationship of pixel number and brightness of the backlight module.

The luminance analysis result is a voltage signal or a current signal. Referring back to FIG. 1, the backlight controller 126 controls the backlight module 140 according to the luminance analysis result, implying that the brightness of the backlight module 140 is dynamically adjusted by the backlight controller 126 in accordance with the luminance or brightness characteristic of each image frame. One exemplary example explaining the adjusting mechanism is described below. It is assumed that the pixel number PN1 of FIG. 3 is chosen as the luminance index. Please refer to FIG. 4. FIG. 4 shows the relationship of pixel number and brightness of the backlight module 140. As the pixel number PN1 ranges from the PNL to PNH, the brightness of the backlight module 140 varies linearly with the pixel number. As shown in FIG. 4, the larger the pixel number PN1, the darker the brightness of the backlight module 140 is. However, the brightness of the backlight module 140 can alternatively be adjusted such that the larger the pixel number PN1, the brighter the brightness of the backlight module 140 is. If the pixel number is lager than PNH or less than PNL, the brightness will be fixed to two different constant values, which are respectively BL and BH. In this case, the pixel number PN1 corresponds to the brightness B1 of the backlight module 140.

Figure 5:
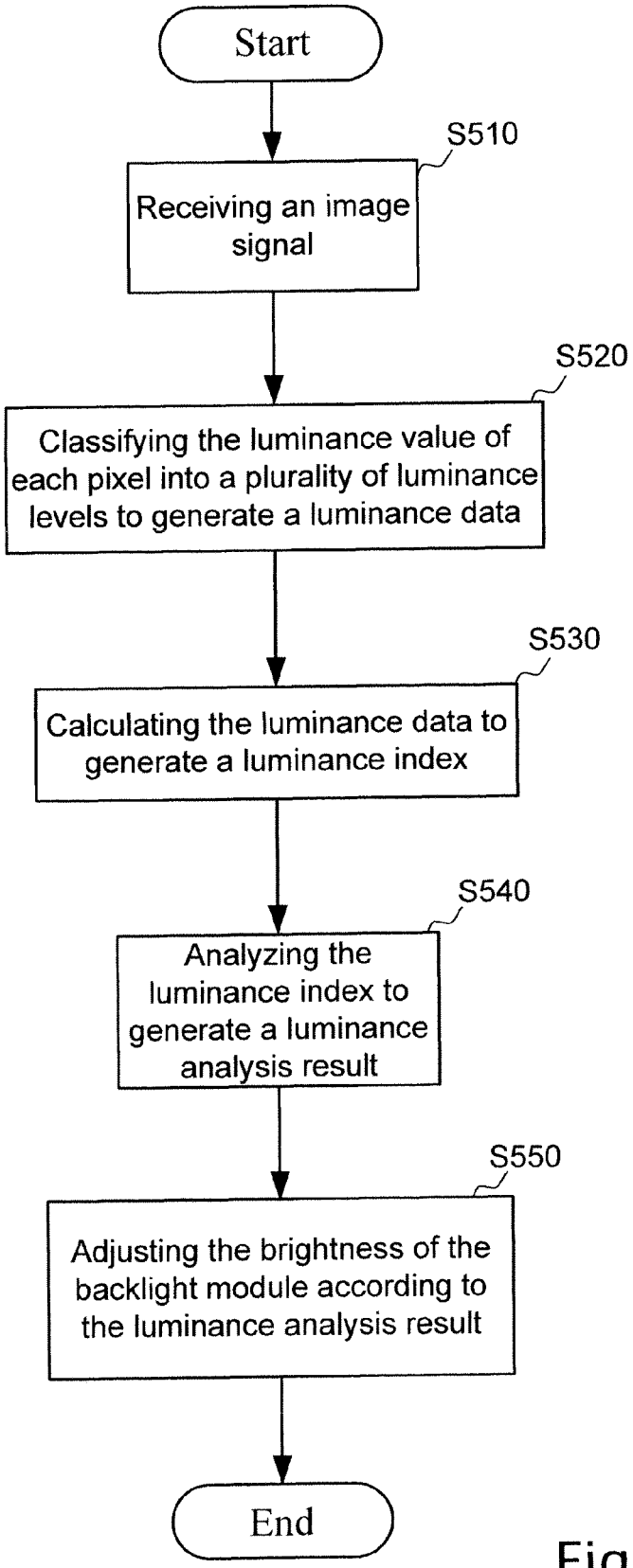
FIG. 5 shows the flow chart of adjusting the backlight module according to the luminance of an image frame.

Please refer to FIG. 5. FIG. 5 shows the flow chart of adjusting the backlight module according to the luminance of the image frame. An image signal containing several image frames is received (S510). Each image frame consists of a number of pixels, and each pixel has a corresponding luminance value. The luminance values of the pixels in an image frame are classified into several luminance levels (S520). If the full range of the luminance value is assumed to be from 0 to 255, and is divided into 8 sections, each luminance level covers an equal number of 32 luminance values. Therefore, the classified luminance values, or referred to as a luminance data, can be illustrated by a histogram as shown in FIG. 3, which is an example of the preferred embodiment. The luminance data is then calculated to generate a luminance index (S530). The luminance index can be the pixel number of a certain luminance level, e.g., the pixel number of the lowest luminance level PN1, or an average luminance value, avg_LV, of the image frame, or a combination of them such as PN1 along with PN8 or PN2 along with avg_LV. The average luminance value can be obtained by Eq. 1. The luminance index is then analyzed to generate a luminance analysis result (S540). In the process of generating the luminance analysis result, a lookup table is referred to according to the luminance index. Finally, the backlight module is adjusted according to the luminance analysis result (S550). The brightness of the backlight module can be adjusted in accordance with various mechanisms. For example, if the luminance index indicates that a low luminance image is shown, the brightness of the backlight module can be adjusted to a brighter status or a darker status, depending on the practical usage. As a result, the backlight module can be adjusted dynamically to provide a suitable brightness according to the images, and hence the image quality can be improved.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A display apparatus that improves contrast by dynamically adjusting backlight thereof, comprising:

a receiving circuit for receiving and processing an incoming signal to generate an image signal;

an image processing circuit, coupled to the receiving circuit, for processing the image signal and generating a driving signal;

a display unit, coupled to the image processing unit and driven by the driving signal to display contents of the image signal;

a luminance analysis circuit, coupled to the receiving circuit, for analyzing the image signal and generating a luminance analysis result, wherein the luminance analysis circuit comprises:

a luminance classifying circuit for receiving the image signal and classifying the luminance value of each pixel into a plurality of luminance levels to generate a luminance data;

a calculating circuit, coupled to the luminance classifying circuit, for calculating the number of pixels of at least one of the luminance levels and an average of the luminance values of all pixels in a frame, and generating a luminance index at least comprising the number of pixels of one of the luminance level selected from all the luminance levels and the average of the luminance values of all pixels in a frame; and a luminance index analyzing circuit, coupled to the calculating circuit, for analyzing the luminance index to generate the luminance analysis result according to a table referring to both of the number of pixels of one of the luminance level selected from all the luminance levels and the average of the luminance values of all pixels in a frame at the same time;

a backlight module for irradiating the display unit, comprising a first MOSFET, a second MOSFET, a voltage transformer, a lamp and a resistor, wherein the voltage transformer is coupled to the first MOSFET, the second MOSFET, a voltage source and a ground point, and the lamp is coupled between the voltage transformer and the resistor; and a backlight controller, coupled to the luminance analysis circuit and the backlight module, for generating a control signal according to the luminance analysis result to control the backlight module, wherein the first MOSFET and the second MOSFET receive the control signal at the gate terminals of the first MOSFET and the second MOSFET respectively.

2. The display apparatus of claim 1 further comprising a memory coupled to the luminance index analyzing circuit for storing at least a lookup table; wherein the luminance index analyzing circuit refers to the lookup table to generate the luminance analysis result.

3. The display apparatus of claim 1, wherein the control signal is a PWM signal which controls the on and off states of the backlight module to adjust the brightness.

4. The display apparatus of claim 3, wherein the duty cycle of the PWM signal is determined by the luminance analysis result.

5. A control circuit for controlling a display unit and a backlight module including a first MOSFET, a second MOSFET, a voltage transformer coupled to the first MOSFET and the second MOSFET, wherein the backlight module further comprises a lamp and a resistor coupled between the voltage transformer and the resistor, to improve the contrast of the display unit by dynamically adjusting the backlight module, the backlight module irradiating the display unit, the control circuit comprising:

an image processing circuit for receiving and processing an image signal containing a plurality of image frames to be displayed on the display unit;

a luminance analysis circuit for receiving the image signal and analyzing luminance values of the image signal to generate a luminance analysis result, wherein the luminance analysis circuit comprises:

a luminance classifying circuit for receiving the image signal and classifying the luminance value of each pixel into a plurality of luminance levels to generate a luminance data;

a calculating circuit, coupled to the luminance classifying circuit, for at least calculating the number of pixels of one of the luminance levels selected from all the luminance levels and the average of the luminance values of all the luminance levels and the average of the luminance values of all pixels in a frame, and generating a luminance index at least comprising the number of pixels of one of the luminance level selected from all the luminance levels and the average of the luminance values of all pixels in a frame; and a luminance index analyzing circuit, coupled to the calculating circuit, for analyzing the luminance index to generate the luminance analysis result according to a table referring to both of the number of pixels of one of the luminance level selected from all the luminance levels and the average of the luminance values of all pixels in a frame at the same time; and a backlight controller, coupled to the luminance analysis circuit, for generating a control signal to control the backlight module according to the luminance analysis result, wherein the first MOSFET and the second MOSFET receive the control signal at the gate terminals of the first MOSFET and the second MOSFET respectively.

6. The control circuit of claim 5 further comprising a memory coupled to the luminance index analyzing circuit for storing at least a lookup table; wherein the luminance index analyzing circuit refers to the lookup table to generate the luminance analysis result.

7. The control circuit of claim 5, wherein the control signal is a PWM signal which controls the on and off states of the backlight module to adjust the brightness.

8. The control circuit of claim 7, wherein the duty cycle of the PWM signal is determined by the luminance analysis result.

9. A method for displaying contents of an image signal on a display unit and controlling a backlight module irradiating the display unit according to an analysis of the image signal, comprising:

processing the image signal and generating a driving signal to drive the display unit;

displaying contents of the image signal;

analyzing luminance values of the image signal to generate a luminance analysis result, wherein the step of analyzing luminance values of the image signal further comprises:

classifying the luminance value of each pixel into a plurality of luminance levels to generate a luminance data;

calculating the number of pixels of one of the luminance levels and an average of the luminance values of all pixels in a frame; and generating a luminance index at least comprising the number of pixels of one of the luminance levels selected from all the luminance levels and the average of the luminance values of all pixels in a frame; and analyzing the luminance index to generate the luminance analysis result; and generating a control signal to control the backlight module according to the luminance analysis result according to a table referring to both of the number of pixels of one of the luminance level selected from all the luminance levels and the average of the luminance values of all pixels in a frame at the same time, wherein the backlight module comprises a first MOSFET, a second MOSFET, a voltage transformer, a lamp and a resistor, the voltage transformer is coupled to the first MOSFET, the second MOSFET, a voltage source and a ground point, and the lamp is coupled between the voltage transformer and the resistor.

10. The method of claim 9, wherein the step of analyzing the luminance index to generate the luminance analysis result comprises:

referring to a lookup table to generate the luminance analysis result.

11. The method of claim 9, wherein the control signal is a PWM signal which controls the on and off states of the backlight module to adjust the brightness.

12. The method of claim 11, wherein the duty cycle of the PWM signal is determined by the luminance analysis result.

* * * * *